US005656136A

United States Patent [19]

Gayaut et al.

[11] Patent Number: 5,656,136

[45] Date of Patent: Aug. 12, 1997

[54] METHOD OF TRANSPORTING AND HEATING A LIQUID USED FOR TREATING OIL AND GAS WELLS OR PIPELINE SYSTEMS

[75] Inventors: Gilbert A. Gayaut, Sugarland; James R. Burton, Groesbeck, both of Tex.

[73] Assignee: Pool Company, Houston, Tex.

[21] Appl. No.: 456,147

[22] Filed: May 31, 1995

Related U.S. Application Data

[62] Division of Ser. No. 151,541, Nov. 12, 1993.

[51] Int. Cl.[6] ..... E21B 43/00

[52] U.S. Cl. ..... 166/302; 166/90.1; 166/91.1

[58] Field of Search ..... 166/303, 90.1, 166/57, 302, 91.1; 165/51, 41; 137/351, 889.4

[56] References Cited

U.S. PATENT DOCUMENTS

| | | | |
|---|---|---|---|
| 2,506,412 | 5/1950 | Chansse | 137/351 X |
| 2,903,189 | 9/1959 | Patton | 165/41 X |
| 3,092,325 | 6/1963 | Brown, Jr. et al. | 126/19.5 |
| 3,100,528 | 8/1963 | Plummer et al. | 166/303 |
| 3,298,438 | 1/1967 | Anthony et al. | 166/90.1 |
| 4,139,019 | 2/1979 | Bresie et al. | 137/351 |
| 4,190,205 | 2/1980 | Mitchell | 126/19.5 |
| 4,196,854 | 4/1980 | Prucyk | 126/19.5 |
| 4,212,354 | 7/1980 | Guinn | 166/303 |
| 4,372,386 | 2/1983 | Rhoades et al. | 166/300 |
| 4,443,909 | 4/1984 | Cameron | 165/51 |
| 4,534,408 | 8/1985 | Thibonnet | 165/108 |
| 4,589,488 | 5/1986 | Schirmer | 166/303 X |
| 4,828,079 | 5/1989 | Fujinami | 165/41 |
| 5,098,036 | 3/1992 | Brigham et al. | 244/134 R |
| 5,190,249 | 3/1993 | Whitmire et al. | 244/134 C |

*Primary Examiner*—Hoang C. Dang
*Attorney, Agent, or Firm*—Crutsinger & Booth

[57] ABSTRACT

An apparatus and method for heating transporting and heating a liquid for treating oil and gas wells and pipeline systems is provided. The apparatus includes a vehicle having an engine and a tank for transporting a liquid that can be used for treating oil wells or pipeline systems is connected to move with the vehicle. A heat exchanger system is operatively connected to the engine. A selectively operable circulating pump and a circulating line are operatively connected between said tank and said heat exchanger system for circulating the liquid from the tank through the heat exchanger system to heat the liquid. The apparatus includes at least one selectively operable valve for controlling the flow of liquid through the circulating pump, the circulating line, and the heat exchanger system. Liquid is pumped through the heat exchanger system to use heat energy from the engine to heat the liquid to a predetermined temperature prior to use for treating an oil well or pipeline system. The method includes the steps of: loading a tank on a truck with a treatment liquid; driving the truck to a remote site; while the engine is running, circulating the treatment liquid through a heat exchange system that is operatively connected to the engine of the vehicle, thereby heating the liquid to a predetermined temperature; and then discharging the heated liquid into an oil and gas well or pipeline system.

2 Claims, 4 Drawing Sheets

METHOD OF TRANSPORTING AND HEATING A LIQUID USED FOR TREATING OIL AND GAS WELLS OR PIPELINE SYSTEMS

This application is a division of application Ser. No. 08/151,541, filed Nov. 12, 1993.

FIELD OF THE INVENTION

The present invention relates to an apparatus and method for transporting and heating a water or petroleum based liquid for injection into an oil or gas well or into a pipeline system.

BACKGROUND OF THE INVENTION

It is common in the oil and gas industry to treat oil and gas wells and pipelines with heated liquids such as water and oil. For example, one such application is to treat the tubulars of an oil and gas well with heated oil to remove any build up of paraffins along the tubulars that precipitate from the oil stream that is normally pumped therethrough.

In the past the treatment liquid has been heated with a heat exchanger employing an open flame heat source. However, an open flame at the well site poses a substantial risk of explosion and uncontrolled fire, which can destroy the investment in the rig and injure or even cost the lives of the well operators. Current U.S. government safety regulations provide that the open flame heating of the treatment liquid cannot take place within the immediate vicinity of the well. While safety concerns are of overriding importance, compliance with the no open-flame regulations requires additional time and expense to conduct the heated liquid well treatment.

Thus, there has been a long felt need for a safer apparatus and method of heating a treatment liquid for injecting into the tubulars of oil and gas wells and pipelines without using an open flame heat source in the vicinity of the treatment location.

SUMMARY OF THE INVENTION

According to one aspect of the invention, an apparatus for transporting and heating a liquid for treating oil wells and pipeline systems is provided. The apparatus includes a vehicle having an engine. A tank for transporting a liquid that can be used for treating oil wells or pipeline systems is connected to move with the vehicle. A heat exchanger system is operatively connected to the engine. A selectively operable circulating pump and a circulating line are operatively connected between said tank and said heat exchanger system for circulating the liquid from the tank through the heat exchanger system to heat the liquid. The apparatus includes at least one selectively operable valve for controlling the flow of liquid through the circulating pump, the circulating line, and the heat exchanger system. Thereby the liquid can be pumped through the heat exchanger system to use heat from the engine to heat the liquid to a predetermined temperature prior to use for treating an oil well or pipeline system.

According to another aspect of the invention, the apparatus also includes a selectively operable injection pump that has a low pressure side and a high pressure side. A pump inlet line is operatively connected between the tank and the low pressure side of the injection pump, and an injection line is operatively connected to the high pressure side of the injection pump. The injection line has a port for operatively connecting the injection line to an oil well or pipeline system. At least one selectively operable valve is included in the apparatus for controlling the flow of liquid through the pump inlet line, the injection pump, and the injection line. Thereby liquid from the tank can be selectively injected into the well or pipeline system.

According to another aspect of the invention, the apparatus includes a recirculating line operatively connected between the high pressure side of the injection pump and the tank for returning liquid from the high pressure side of the injection pump back to the tank. A choke valve is positioned in the recirculating line for providing resistance to the flow of liquid. The apparatus includes at least one selectively operable valve for controlling the flow of liquid through the recirculating line and the injection pump. Thereby the circulation of the liquid through the injection pump and the choke valve in the recirculating line can be selectively controlled for heating the liquid in the tank to a predetermined temperature prior to use for treating an oil well or pipeline system.

According to yet another aspect of the invention, the heat exchanger system includes one or more heat exchangers for capturing and using heat energy generated by the vehicle engine. For example, the typical internal combustion engine has a water jacket cooling system for dissipating engine heat. The transmission, transmission retarder, and exhaust system of the engine can also be sources of heat energy. Thus, a heat exchanger system according to the present invention can include one or more of the following: a water jacket heat exchanger operatively connected to the water jacket cooling system; a transmission heat exchanger operatively connected to the transmission or transmission retarder; and an exhaust heat exchanger operatively connected to the exhaust system. The heat exchangers are positioned and designed to maximize the utilization of heat energy from the vehicle engine for heating the treatment liquid.

According to the present invention, a method of transporting and heating a liquid used for treating oil and gas wells and pipeline systems is also provided. The method includes the steps of: loading a tank mounted to a truck with a treatment liquid, driving the truck to a remote location of an oil and gas well or pipeline system; while the engine is running, circulating the liquid in the tank through a heat exchanger system operatively connected to the engine of the truck, whereby heat energy from the engine heats the liquid in the tank to a predetermined temperature; and discharging the heated liquid into the oil and gas well or pipeline system.

BRIEF DESCRIPTION OF THE DRAWINGS

The accompanying drawings are incorporated into and form a part of the specification to illustrate several examples of the present invention. These drawings and the detailed description of the preferred embodiments serve to explain the principles of the invention. The drawings are only for the purposes of illustrating the presently preferred examples of how the invention can be made and used, and the drawings are not to be construed as limiting the invention to only the illustrated embodiment of the invention. The various advantages and features of the present invention will be apparent from a consideration of the drawings in which.

DETAILED DESCRIPTION OF THE PREFERRED EMBODIMENTS

Figure 2:
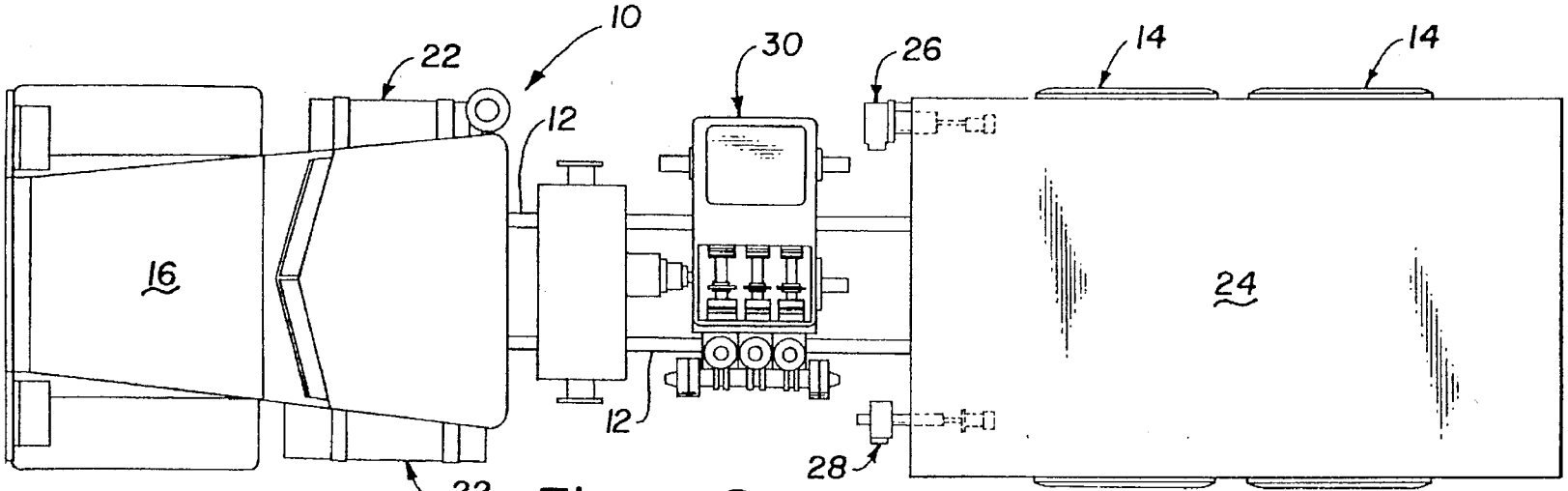
FIG. 2 is a top plan view of the embodiment shown in FIG. 1.
Figure 1:
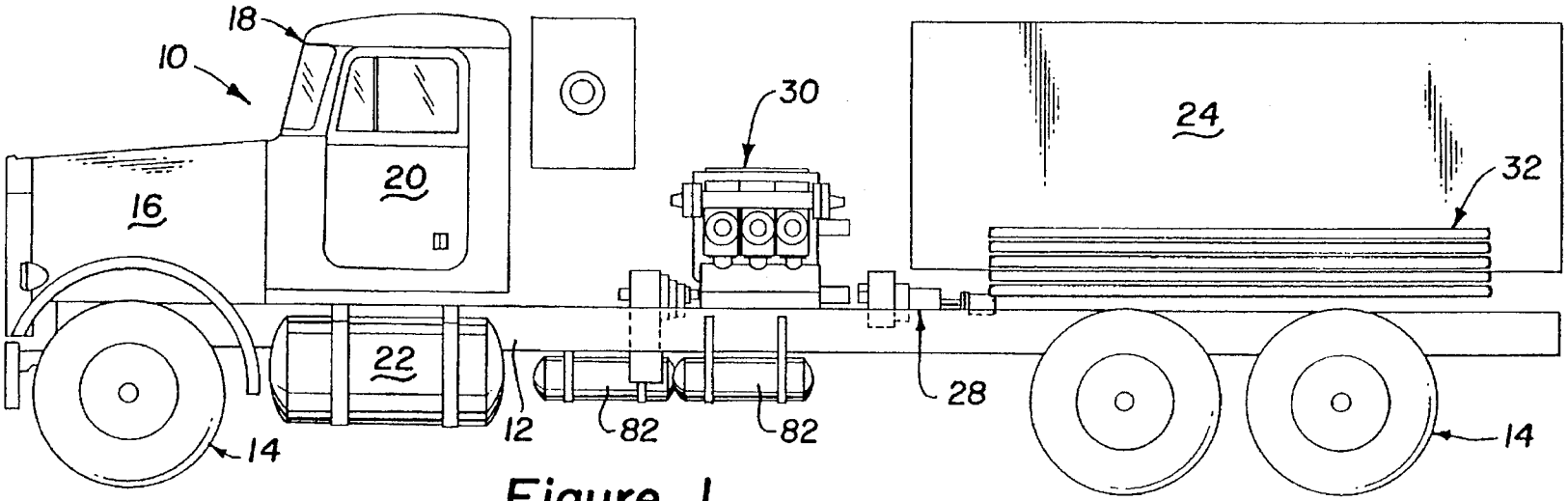
FIG. 1 is a side elevation view of one embodiment of the invention showing a truck type vehicle having an engine for moving the vehicle, the vehicle having a tank for containing a supply of liquid that can be used for treating oil and gas wells and pipeline systems.

Referring now to the drawing, wherein like reference numerals designate corresponding elements throughout the several Figures of the drawing, FIGS. 1 and 2 illustrate a truck 10 for transporting and heating a liquid for treating oil wells and pipeline systems. Truck 10 has a chassis 12, wheels 14, an engine (not shown) positioned under hood 16, a cab 18 having a door 20, and fuel tanks 22.

In the preferred embodiment of the invention illustrated in FIGS. 1 and 2, a tank 24 for holding a liquid used for treating oil wells is mounted to the chassis 12 to move with the vehicle 10. It is to be understood, however, that in an alternative embodiment of the invention, tank 24 can be mounted to a trailer that can be removably connected to move with a vehicle.

Tank 24 may be of any appropriate size and shape for holding a sufficient volume of liquid to provide one liquid injection treatment for an oil well or pipeline system. For example, in one embodiment of the invention the tank 24 can hold about 70 barrels of liquid, which is an effective amount for some well treatment processes. It is anticipated, however, that more or less than 70 barrels may be used, and that more than one truck 10 may be used to treat the well or pipeline.

The liquid for treating the oil well or pipeline system can be water or a petroleum product such as oil. The water or petroleum based liquid can include one or more additives or other components that serve any number of purposes, and can include, for example, corrosion inhibitors, scale inhibitors, paraffin solvents, etc. In typical treatment processes, the liquid is preferably heated to a predetermined temperature. For example, if the treatment liquid is water, it can be desirable to heat it to about 200° F. For some hot oil treatment processes, the oil should preferably be heated to about 250° F.

As shown in FIGS. 1 and 2, the truck 10 also includes a transfer pump 26, a circulating pump 28, and an injection pump 30. Lengths of flexible hose and rigid pipe sections 32 are removably attached to the truck 10 and are used for loading or unloading liquid in the tank as will hereinafter be described in detail.

Figure 3:
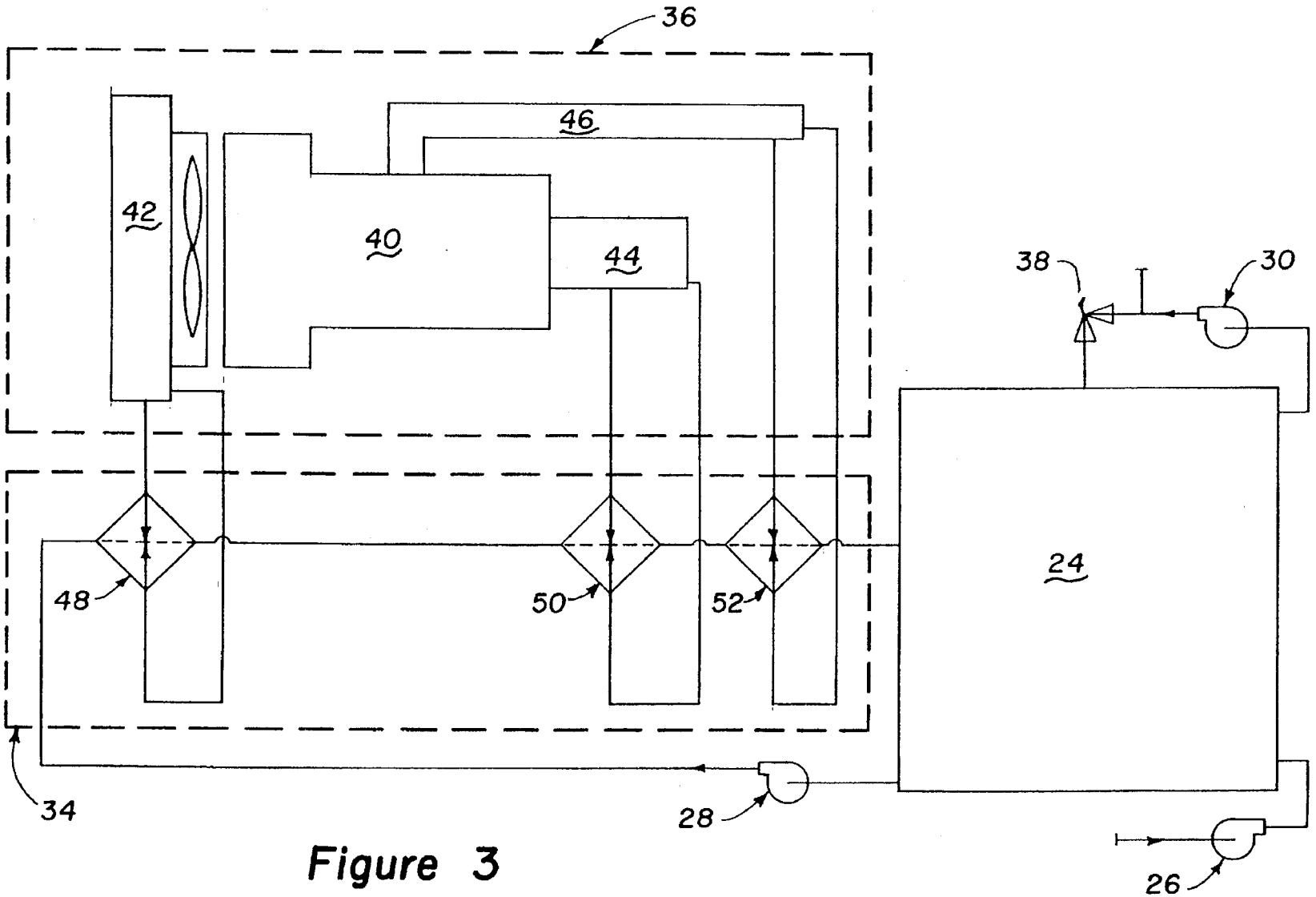
FIG. 3 is a simplified block diagram illustrating several aspects of the invention.

FIG. 3 of the drawing is a simplified diagram of a preferred embodiment of the invention. Tank 24 can be filled with a treating liquid by transfer pump 26. Pump 28 is used to circulate the liquid in tank 24 through a heat exchanger system 34 that is operatively connected to truck engine 36, thereby heating the liquid to a predetermined temperature. Injection pump 30 is used to inject the liquid in the tank 24 into an oil well or pipeline system. Injection pump 30 can also be used to circulate the liquid through a choke valve 38, and the work of pumping the liquid through the choke valve can be transformed into heat energy to heat the liquid.

Truck engine 36 is a typical internal combustion engine including an engine block 40 having a water jacket cooling system 42, a transmission 44, and an exhaust system 46. A portion of the excess heat energy from the truck engine can be captured and utilized by a heat exchanger system 34 operatively connected to the engine 36.

In a preferred embodiment of the invention, each of the major sources of heat from truck engine 36 are operatively connected to the heat exchanger system 34. Accordingly, fluid from the water jacket cooling system 42 is circulated through a water jacket heat exchanger 48. Fluid from the transmission 44 is circulated through a transmission heat exchanger 50. Exhaust gases from the exhaust system 46 is circulated through an exhaust heat exchanger 52. It is to be understood that the heat exchanger system 34 does not have to include all three of the heat exchangers 48, 50, and 52 if sufficient energy can be recovered from the engine 36 to heat the liquid in tank 24 to the desired predetermined temperature.

The arrangement of the heat exchangers 48, 50, and 52 in the heat exchanger system 34 is not critical to the practice of the invention, and the fluid flow through the transfer lines and circulation lines is represented in a simplified manner. For the purposes of the simplified diagram shown in FIG. 3, the valves and control system for controlling the flow of fluids through the heat exchanger system 34, the pumps 26, 28, and 30, and the transfer lines are not shown as they can be arranged in any suitable configuration as well known to those skilled in the art.

Figure 4:
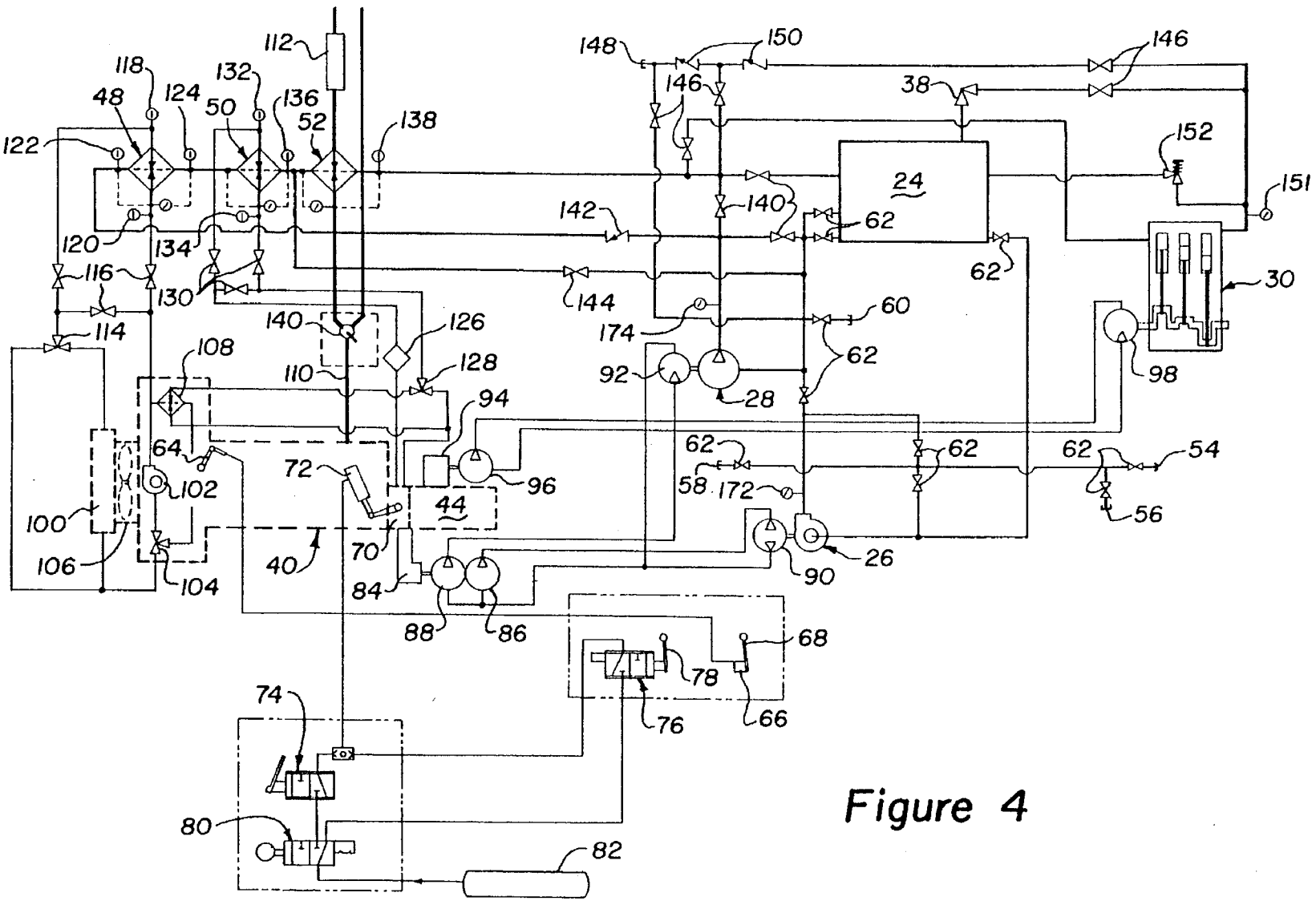
FIG. 4 is a schematic illustrating a presently most preferred embodiment of the invention.

Referring now to FIG. 4 of the drawing, a detailed schematic of a presently most preferred embodiment of the invention is provided that will be readily understood by those skilled in the art. Tank 24 is connected through 3 inch transfer lines to a 3 inch loading line connector 54 at the right side of the truck 10, a 2 inch loading hose connector 56 at the right side of the truck, a 3 inch loading line connector 58 at the left side of the truck, and a 3 inch loading line connector 60 at the rear of the truck. A selectively operable transfer pump 26 and a plurality of selectively operable control valves 62 are connected in the transfer lines to pump and control the flow of liquid through the transfer lines. Thereby the tank 24 can be loaded from any one of several convenient positions about the truck 10. The valves can also be selectively adjusted so that the liquid in the tank 24 can be unloaded through any one of the connectors 54, 56, 58, and 60.

The truck engine includes an engine block 40. The engine block can be, for example, a diesel engine. The engine has a throttle 64 connected through a friction detent throttle control cable 66 having a throttle control lever 68.

The truck engine also includes a transmission 44 and a transmission retarder 70. The transmission 44 is preferably of the automatic type. The transmission retarder 70 is controlled by retarder actuator 72, which in turn is connected to retarder control hand lever valve 74 and friction detent retarder control 76 having a retarder control lever 78. The valve 74 and friction detent retarder control 76 are connected to a local or remote control selector 80, which in turn is connected to a 120 psi air supply 82 from the truck 10.

The transmission 44 is used to selectively provide power to transfer pump 26, circulating pump 28, and injection pump 30. Cable controlled power take off 84 selectively controls power to hydraulic pumps 86 and 88, which in turn provide power to transfer pump drive 90 and circulating pump drive 92, respectively. Transfer pump drive 90 provides power to transfer pump 26, which can be of the gear type. Circulating pump drive 92 provides power to circulating pump 28, which can be of the vane type. Pneumatic controlled power take off 94 selectively controls power to pump 96, which in turn provides power to injection pump drive 98. Injection pump drive 98 provides power to injection pump 30. Injection pump 30 is preferably capable of delivering high pressure liquid from the tank 24 and, in the presently most preferred embodiment is a triplex pump as shown in FIG. 4.

Continuing to refer to FIG. 4 of the drawing, the truck engine has a water jacket cooling system that includes a radiator 100 containing a reservoir of coolant. A truck coolant pump 102 circulates the coolant from the radiator 100 through a water jacket on the engine block 40. The coolant absorbs heat energy from the engine block 40, and the flow of coolant circulating through the water jacket is controlled by engine thermostat 104. A cooling fan 106 circulates ambient air over the radiator 100 for dissipating heat energy from the engine block 40 to the air.

The fluid from the transmission retarder 70 is preferably circulated through a coolant heat exchanger 108 whereby the coolant of the water jacket cooling system can also be used to dissipate heat energy from the transmission retarder 70.

The exhaust from the engine block 40 passes through an exhaust system that includes an exhaust line 110 and a muffler 112.

Pump 28 is used to circulate the liquid in tank 24 through a heat exchanger system 34 that is operatively connected to the truck engine. The heat exchanger system of the preferred embodiment shown in FIG. 4 includes a water jacket heat exchanger 48, a transmission heat exchanger 50, and an exhaust heat exchanger 52. A typical diesel 350 horsepower truck engine can generate in the range of 1.5 million to 2 million BTU of heat energy in about one hour. Thereby the heat exchanger system allows at least a portion of the heat energy to be used to heat the liquid in tank 24 to a predetermined temperature.

Continuing to refer to FIG. 4 of the drawing, coolant from the water jacket cooling system is circulated through a water jacket heat exchanger 48. Flow of coolant through the water jacket heat exchanger 48 is controlled by thermostatic valve 114 and other control valves 116. Temperature gauge 118 indicates the temperature of the coolant flowing into the water jacket heat exchanger 48 from the water jacket cooling system, and temperature gauge 120 indicates the temperature of the coolant flowing out of the water jacket heat exchanger 48. Temperature gauge 122 indicates the temperature of the treating liquid from tank 24 flowing into the water jacket heat exchanger 48, and temperature gauge 124 indicates the temperature of the well treating liquid after it has passed through heat exchanger 48.

Fluid from the transmission retarder 70 of transmission 44 is preferably circulated through transmission heat exchanger 50. The circulation of the fluid from the transmission retarder 70 is preferably also passed through a transmission filter 126. Flow of coolant through the water jacket heat exchanger 48 is controlled by thermostatic valve 128 and other control valves 130. Temperature gauge 132 indicates the temperature of the transmission fluid flowing into the transmission heat exchanger 50 from the transmission retarder 70, and temperature gauge 134 indicates the temperature of the transmission fluid flowing out of the transmission heat exchanger 50. Temperature gauge 124 indicates the temperature of the treating liquid from the water jacket heat exchanger 48 flowing into the transmission heat exchanger 50, and temperature gauge 136 indicates the temperature of the well treating liquid after it has passed through heat exchanger 50.

Exhaust gases from the exhaust system are preferably circulated through an exhaust heat exchanger 52 during times of heating a treating fluid. Temperature gauge 136 indicates the temperature of the treating liquid from the transmission heat exchanger 50 flowing into the exhaust heat exchanger 52, and temperature gauge 138 indicates the temperature of the well treating liquid after it has passed through heat exchanger 52. Exhaust by-pass valve 140 allows the exhaust gases from the engine to be selectively passed through the exhaust heat exchanger 52 or to be routed past the heat exchanger 52 during times of road operation or when fluid heating is not required.

A plurality of valves 140 are provided in the circulating lines for controlling the flow of treatment liquid from the tank 24 through the heat exchangers 48, 50, and 52. Check valve 142 prevents the flow of liquid in an undesired direction. As shown in FIG. 4 of the drawing, heat exchanger by-pass valve 144 can be adjusted so that the flow of liquid from the tank 24 by-passes the water jacket heat exchanger 48 and the transmission heat exchanger 50, passing only through the exhaust heat exchanger 52. It is to be understood, however, that the flow system through the heat exchanger system can be modified to maximize the efficiency of the heat exchange process for heating the liquid in the tank 24.

Injection pump 30 is used to inject the liquid in the tank 24 into an oil well or pipeline system. Treatment liquid from the tank 24 is drawn through inlet lines to the low pressure side of the pump 30 and pumped out the high pressure side of the pump through injection lines into an oil well or pipeline system. The injection pump is preferably capable of developing high pressures for injecting the treatment fluid. For example, in the most preferred embodiment of the invention, the pump 30 is capable of injecting the treatment liquid into a well or pipeline system at up to at least 5,000 psi.

Injection pump 30 can also be used to circulate the treatment liquid through a choke valve 38, recirculating the liquid through recirculating line back into the tank 24. The work of pumping the liquid through the choke valve 38 is transformed into heat energy and heats the liquid. The power of the injection pump 30 circulating liquid across the choke valve 38 is expected to be sufficient to heat 70 barrels (bbl) of treatment water at the rate of about 1° F. per minute. If the transmission 44 does not have sufficient power to drive both the recirculating pump 28 and the injection pump 30, then the two pumps cannot be operated at the same time. In that case, the injection pump 30 and choke valve 38 provide alternative ways to heat the liquid in tank 24.

A plurality of valves 146 are provided in the injection and recirculating lines. Together with previously described valves, valves 146 control the flow of treatment liquid from the tank 24 through the injection pump 30 and through either the choke valve 38 or out the connector at 148 at the end of the injection lines. Check valves 150 prevent any fluid from the oil well or pipeline system from backing up into the injection lines of the truck 10. The high pressure side of the injection pump 30 is also provided with a high pressure gauge 151. A pressure relief valve 152 and a pressure relief return line are provided in case an excessive back pressure develops in either the injection or recirculating lines.

Figure 6:
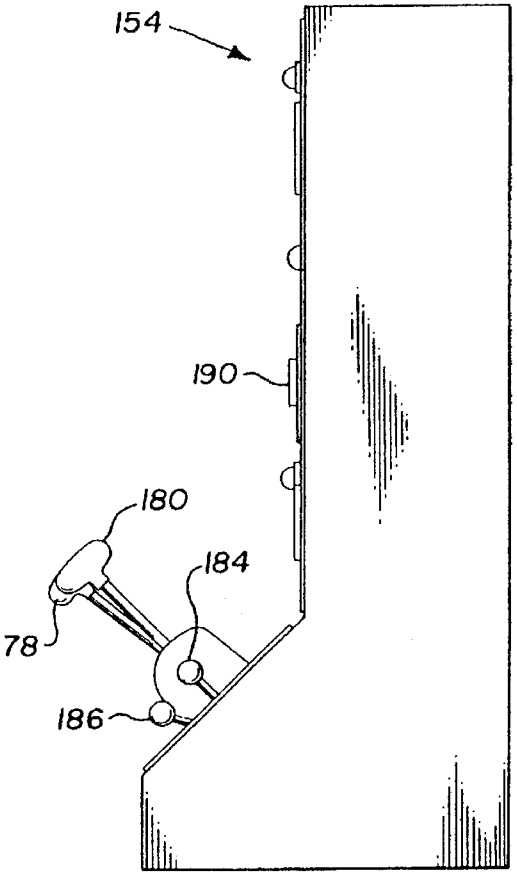
FIG. 6 is a side elevation view of the control panel shown in FIG. 5.
Figure 5:
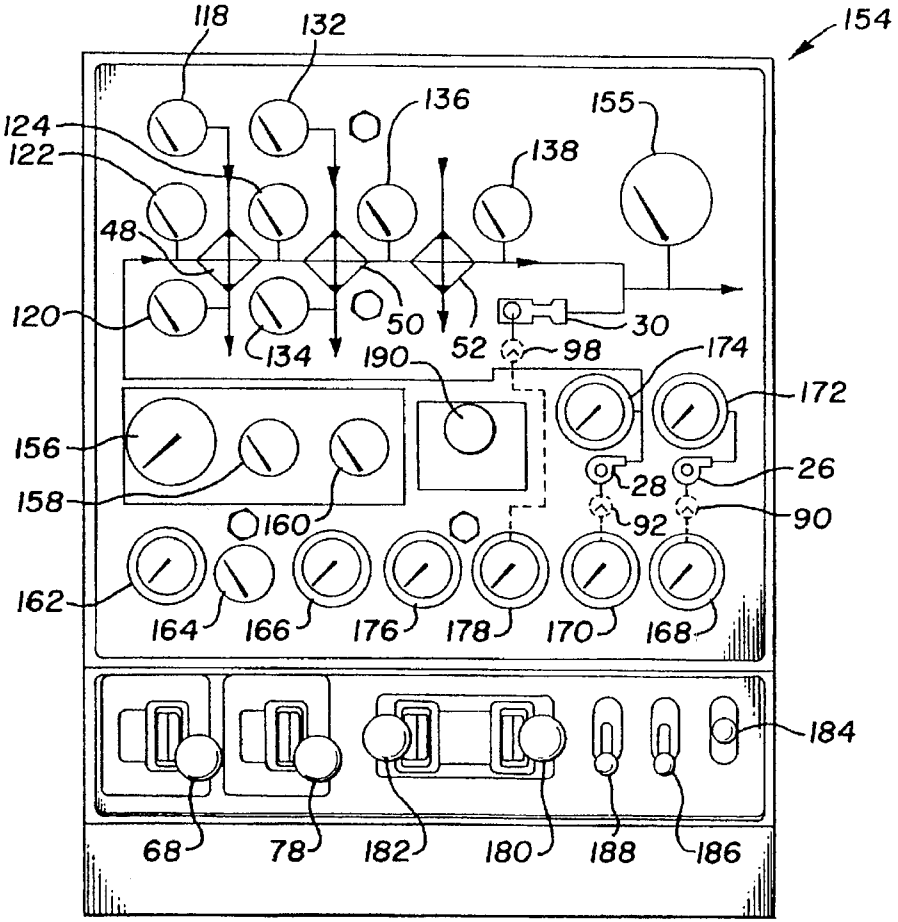
FIG. 5 is a front elevation view of the control panel for the schematic shown in FIG. 4.

FIGS. 5 and 6 illustrate a control panel, generally referred to by the reference numeral 154, for the apparatus shown in the schematic of FIG. 4. As best shown in FIG. 5, the apparatus according to a preferred embodiment of the invention is represented on the control panel 154 is represented by a simplified flow diagram. Box 48 of the flow diagram represents the water jacket heat exchanger 48, box 50 represents the transmission heat exchanger 50, and box 52 represents the exhaust heat exchanger 52. The transfer pump 26 is illustrated by the icon 26, the circulating pump 28 is illustrated by the icon 28, and the injection pump 30 is illustrated by the icon 30. Transfer pump drive 90 for transfer pump 26 is illustrated by the icon 90, circulating pump drive 92 is illustrated by the icon 92, and the injection pump drive 98 is illustrated by the icon 98. Fluid flow and connection lines are indicated by lines and arrows on the diagram of the control panel 154.

Temperature gauge 118 indicates the temperature of the coolant flowing into the water jacket heat exchanger 48 from the water jacket cooling system, and temperature gauge 120 indicates the temperature of the coolant flowing out of the water jacket heat exchanger 48. Temperature gauge 122 indicates the temperature of the treating liquid from tank 24 flowing into the water jacket heat exchanger 48, and temperature gauge 124 indicates the temperature of the well treating liquid after it has passed through heat exchanger 48.

Temperature gauge 132 indicates the temperature of the transmission fluid flowing into the transmission heat exchanger 50 from the transmission retarder 70, and temperature gauge 134 indicates the temperature of the transmission fluid flowing out of the transmission heat exchanger 50. Temperature gauge 124 indicates the temperature of the treating liquid from the water jacket heat exchanger 48 flowing into the transmission heat exchanger 50, and temperature gauge 136 indicates the temperature of the well treating liquid after it has passed through heat exchanger 50.

Temperature gauge 136 indicates the temperature of the treating liquid from the transmission heat exchanger 50 flowing into the exhaust heat exchanger 52, and temperature gauge 138 indicates the temperature of the well treating liquid after it has passed through heat exchanger 52.

Temperature gauge 155 indicates the temperature of the treatment liquid in the tank 24. Once the temperature of the liquid in the tank reaches the desired temperature, the circulation of the liquid through the heat exchangers can be stopped.

The control panel has a throttle control lever 68 and a retarder control lever 78. The control panel includes tachometer 156 that indicates the engine revolutions per minute (RPM), engine oil temperature gauge 158, and engine oil pressure gauge 160. Air pressure gauge 162 indicates the truck air pressure provided by truck air supply 82. A hydraulic oil temperature gauge 164 is also provided.

As previously described, transmission 44 is connected to hydraulic pumps 86 and 88 that in turn provide power to the transfer pump drive 90 and the circulating pump drive 92, respectively. Transfer pump drive 90 drives transfer pump 26, and circulating pump drive 92 drives circulating pump 28. On the control panel 154, pressure gauge 166 indicates the combined pump charge of the hydraulic pumps 86 and 88, pressure gauge 168 indicates the pressure of transfer pump drive 90, pressure gauge 170 indicates the pressure of circulating pump drive 92, pressure gauge 172 indicates the pressure from transfer pump 26, and pressure gauge 174 indicates the pressure from circulating pump 28. Pressure gauges 172 and 174 are also represented on the schematic of FIG. 4.

Similarly, transmission 44 is connected to pump 96 that in turn provides power to the injection pump drive 98. Injection pump drive 98 drives injection pump 30. Referring back to the control panel 154 shown in FIG. 5, pressure gauge 176 indicates the pump charge of the pump 96, and pressure gauge 178 indicates the pressure of the injection pump drive 98.

Power take off control lever 180 is used to engage or disengage the power take off 84 to control power from transmission 44 to hydraulic pumps 88 and 86 for transfer pump 26 and circulating pump 28. Power take off control lever 182 is used to engage or disengage the power take off 94 to control power form transmission 44 to pump 96 for injection pump 30.

Transfer control lever 184 controls the pumping of liquid through the transfer pump 26 to load the tank 24 with treatment liquid. Circulating control lever 186 controls the pumping of treatment liquid through the circulating pump 26 for heating the liquid to a predetermined temperature. And injection control lever 188 control the pumping of liquid through the injection pump 30 for circulating the liquid through choke valve 38 or delivering the liquid through injection lines to the oil well or pipeline system.

In the event that there is any kind of problem or emergency, the control panel 154 includes an emergency stop button 190 that will kill the truck engine and any operating pumps.

Also according the present invention, a method of transporting and heating a liquid used for treating oil and gas wells and pipeline systems is provided. The method includes the steps of: attaching a tank 24 to a vehicle 10, the vehicle having an engine 36; operatively connecting a heat exchanger system 34 to the engine 36; operatively connecting a circulating line and a circulating pump 28 between the tank 24 and the heat exchanger system 34; while the engine is running, circulating the liquid in the tank 24 through the heat exchanger system 34, whereby heat energy from the engine is used to heat the liquid in the tank to a predetermined temperature, and discharging the heated liquid from the tank 24 into the oil and gas well or pipeline system.

In a preferred embodiment of the invention shown in FIGS. 3 and 4, an injection line and injection pump 30 are operatively connected to the tank 24 for injecting the heated treatment liquid under high pressure into an oil and gas well or a pipeline system.

In another aspect of the method, it includes the step of operatively connecting a recirculating line to the high pressure side of the injection pump 30 for recirculating the liquid from the tank 24 through the recirculating line and back to the tank, the recirculating line having a choke valve 38 for creating resistance to flow through the recirculating line. The work of overcoming the resistance of the flow of liquid through the choke valve 38 can be converted to heat energy used for heating the treatment liquid to the predetermined temperature.

In a most preferred embodiment of the method, the heat exchanger system 34 has a water jacket heat exchanger 48, a transmission heat exchanger 50, and an exhaust heat exchanger 52 and the method includes the steps of operatively connecting the water jacket heat exchanger 48 to the water jacket cooling system 42; operatively connecting the transmission heat exchanger 50 to the transmission 44; and operatively connecting the exhaust heat exchanger 52 to the engine exhaust system 46. The flow of liquid can be selectively controlled to flow through any one or more of the water jacket heat exchanger 48, the transmission heat exchanger 50, and the exhaust heat exchanger 52.

It is to be understood, however, that even through numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

Having described the invention, what is claimed is:

1. A method of transporting and heating a liquid used for treating oil and gas wells or pipeline systems, the method comprising the steps of:

(a) attaching a tank to a vehicle, the vehicle having an engine;

(b) operatively connecting a heat exchanger system to the engine;

(c) operatively connecting a circulating line and a circulating pump between the tank and the heat exchanger system;

(d) while the engine, is running, circulating the liquid in the tank through the heat exchanger system, whereby heat energy from the engine heats the liquid in the tank;

(e) operatively connecting an injection line to the tank for discharging liquid into the wells or pipeline systems;

(f) operatively connecting an injection pump to the injection line, whereby liquid from the tank can be injected through the injection line and into the oil and gas wells or pipeline systems under high pressure;

(g) operatively connecting a recirculating line to the high pressure side of the injection pump for recirculating the liquid from the tank, through the recirculating line and back to the tank, the recirculating line having a choke valve for creating resistance to flow through the recirculating line, whereby recirculating liquid from the tank through the injection pump and choke valve heats the liquid in the tank; and (h) discharging the heated liquid into the oil and gas wells or pipeline systems.

2. A method of transporting and heating a liquid used for treating oil and gas wells or pipeline systems, the method comprising the steps of:

(a) operatively connecting an injection line to a tank for discharging liquid into the wells or pipeline systems;

(b) operatively connecting an injection pump to the injection line, whereby liquid from the tank can be injected through the injection line and into the oil and gas wells or pipeline systems under pressure;

(c) operatively connecting a recirculating line to the high pressure side of the injection pump for recirculating the liquid from the tank, through the recirculating line and back to the tank, the recirculating line having a choke valve for creating resistance to flow through the recirculating line, whereby recirculating liquid from the tank through the injection pump and choke valve heats the liquid in the tank; and (d) discharging the heated liquid into the oil and gas wells or pipeline systems.

* * * * *

UNITED STATES PATENT AND TRADEMARK OFFICE

CERTIFICATE OF CORRECTION

PATENT NO. : 5,656,136

DATED : August 12, 1997

INVENTOR(S) : Gilbert A. Gayaut, et al.

It is certified that errors appear in the above-identified patent and that said Letters Patent is hereby corrected as shown below:

In the Abstract line 1, delete the word "heating";

In Column 6, line 39 after "through," insert –a–;

In Column 6, line 67 delete "is represented", second occurrence;

In Column 7, line 48 delete the word "A" and insert –An–;

In Column 8, line 9 delete the word "form" insert –from–;

In Column 8, line 16 delete the word "control" insert –controls–;

in Column 8, line 65 delete the word "through" insert –though–;

in Column 9, line 19 delete the comma after the word "engine" .

Signed and Sealed this

Thirtieth Day of December, 1997

Bruce Lehman

*Attest:*

BRUCE LEHMAN

*Attesting Officer*

*Commissioner of Patents and Trademarks*